US008596517B1

(12) United States Patent
Flennory

(10) Patent No.: US 8,596,517 B1
(45) Date of Patent: Dec. 3, 2013

(54) SECURITY POSTCARD

(76) Inventor: Betty D. Flennory, Birmingham, AL (US)

( * ) Notice: Subject to any disclaimer, the term of this patent is extended or adjusted under 35 U.S.C. 154(b) by 1523 days.

(21) Appl. No.: 11/673,963

(22) Filed: Feb. 12, 2007

(51) Int. Cl.
*B42D 15/00* (2006.01)

(52) U.S. Cl.
USPC ..... 229/92.8; 40/124.01; 40/124.191; 283/101; 283/72

(58) Field of Classification Search
USPC ..... 229/92.8, 92.9; 283/72, 99, 100, 101, 283/114; 40/124.01, 124.191
See application file for complete search history.

(56) References Cited

U.S. PATENT DOCUMENTS

| | | | | |
|---|---|---|---|---|
| 2,363,472 A | | 11/1944 | Ritter | |
| 2,805,816 A | * | 9/1957 | Morgan | 229/92.8 |
| 3,126,211 A | | 3/1964 | Etal | |
| 3,329,333 A | | 7/1967 | Ormond | |
| 3,762,630 A | * | 10/1973 | Braznell | 229/92.8 |
| 4,009,892 A | | 3/1977 | Nickerson, III | |
| 4,079,881 A | * | 3/1978 | Sabb | 229/92.8 |
| 4,278,199 A | | 7/1981 | Tanaka | |
| 4,428,526 A | | 1/1984 | Riley | |
| 4,872,705 A | | 10/1989 | Hartfeil | |
| 4,938,414 A | * | 7/1990 | Lippert | 229/92.8 |
| 4,938,506 A | | 7/1990 | Matsuguchi et al. | |
| 5,657,869 A | * | 8/1997 | Carroll, III | 206/451 |
| 7,707,758 B2 | * | 5/2010 | Stagg | 40/600 |

* cited by examiner

*Primary Examiner* — Jes F Pascua
*Assistant Examiner* — Peter Helvey
(74) *Attorney, Agent, or Firm* — Schmeiser, Olsen & Watts LLP

(57) ABSTRACT

A mailing card for mailing confidential information securely, comprising: a card having a front and a back and configured to be mailed; a display layer over the front of the card; a security shield removably coupled to the display layer and including a design substantially matching the design of the display layer, wherein the security shield is selectably coupleable to a portion of the back of the card and substantially opaque thereby enabling a user to obscure writing thereon. In addition, the security shield includes a pressure sensitive adhesive layer. Moreover, the security shield is sized smaller than the display layer and matches the design of the display layer at borders of the security shield when disposed at a predetermined location over the display layer. Furthermore, the security shield substantially identically matches a portion of the design of the display layer.

2 Claims, 4 Drawing Sheets

SECURITY POSTCARD

BACKGROUND OF THE INVENTION

1. Field of the Invention

The present invention relates to mailing cards, specifically a mailing card for mailing confidential information securely.

2. Description of the Related Art

Post cards have been a simple and convenient way to send a quick message without the process of actually writing a complete letter and envelope. Post cards are a privately printed mailing card of any light color which does not prevent legible addresses and postmarks from being displaced on the mailing card. However, postal restrictions limit the size, shape, and thickness of privately produced post cards. In addition, opaque covers have been utilized to conceal private and personal information or messages from unwanted viewers. Furthermore, upon receiving the mailing card with an attached opaque cover the recipient can detach the adhesive member and reveal the private or personal information without damaging the message contained within.

Some improvements have been made in the field. Examples include but are not limited to the references described below, which references are incorporated by reference herein:

U.S. Pat. No. 4,872,705, issued to Hartfeil, discloses a post card for sending confidential information comprises a stiff rectangular card body measuring no less than 3.5 inches by 5 inches, no greater than 4.5 inches by 6 inches (in certain cases no greater than 6 inches by 10 inches), and has a face on which postage and at least a recipient's (addresses) address are to appear. A sender's return address may also appear on the face of the card body. A predetermined area of the face may be covered with an opaque address label, bearing either the addressee's or the sender's address, and having an exposed surface and a reverse surface securable (at least around its entire periphery) to the card body to conceal the indicia which conveys the confidential information at the label/card face interface. The label is secured to the card body in such manner than tampering with said label will be detachable by the recipient.

U.S. Pat. No. 4,428,526, issued to Riley, discloses a reply card arrangement that comprises a reply card detachable from a plurality of folded pages. The reply card is composed of two sheet portions in superimposed relation and adhesively secured together along a side of each. A first sheet portion of the two ply reply card has discontinuous score lines thereon defining a detachable flap raisable from the first sheet portion to exposed to view a part of the inside surface of the second sheet of the two ply reply card. Confidential information may be entered on the exposed part which is then covered by the flap which may be secured to the second sheet portion with a wettable adhesive located along the margin of the flap.

U.S. Pat. No. 4,278,199, issued to Tanaka, discloses a post card that includes a rectangular-shaped base member conforming in shape and size to requirements of the United Postal Service, and an opaque cover member of substantially smaller size than the base member attached to the base member. At least a portion of the information to be transmitted by use of the post card is carried in full view at one face of the base member. Another portion of the information is carried on one of the facing surfaces of the base and cover members for normally hiding such portion from view. At least a portion of the cover member, or a portion of the base member underlying the cover member, is removable by the recipient of the post card to expose to view such normally-hidden message portion. The portion of the message to be hidden may be imprinted before the cover member is attached to the base member. Alternatively, means may be included for transferring impressions entered on the cover member, or base member opposite the cover member, onto the underlying cover or base member to allow for the entering of the hidden portion of the message after the cover member is affixed to the base member.

U.S. Pat. No. 4,009,892, issued to Nickerson III, discloses a bank check that includes a secret alphanumeric code designation known only to the correct payee which is covered with a light-impervious cover having a light-sensitive material micro-encapsulated in the surface adjacent to the surface of the bank check. The light-sensitive material is released in a predetermined pattern by pressure exerted against the combination of the cover and the check so that whenever the cover is removed, the light-sensitive material is exposed and the pattern becomes visible to thereby make premature removal detectible.

U.S. Pat. No. 4,938,506, issued to Matsuguchi, discloses a postcard that comprises a postcard material, and a sticking material adhered on the postcard material for covering at least a part of the postcard material. The sticking material comprises a base material formed with a heat adherent resin layer on its main surface, whereon an adhesion retarding layer which reduces the adhesive force of the heat adherent resin layer to weaken adhesiveness to the postcard material is formed. A perforation is formed extending from one edge of the base material to the other edge thereof at a portion where the adhesion retarding layer is formed, and the base material can be cut by the perforation. Accordingly, the sticking material can be easily peeled off from the postcard material, enabling access to various information formed thereon.

U.S. Pat. No. 3,329,333, issued to Ormond, discloses a post card comprised of a single basic indicia receiving sheet, an opaque cover sheet having a cut out section and a corner removed therefrom and a tacky adhesive around the periphery of the undersurface portion thereof, a removable intermediate sheet attached to and covering said tacky undersurface of said cover sheet, one edge portion of said cover sheet being removably adhered to said basic sheet by the tacky undersurface of the said cover sheet and in registry with some preselected portion of the upper surface of said basic sheet whereby when the removable intermediate sheet is removed and the remainder of said tacky undersurface of said cover sheet is brought into contact with said upper surface of said basic sheet said cover sheet is releasably adhered to the said preselected portion of said upper surface of said basic sheet and a preselected portion of the indicia on the basic sheet is visible through the cut out section.

U.S. Pat. No. 3,126,211, issued to Etal, discloses a first sheet that bears indicia thereon indicative of the addressee and the confidential information. A thin opaque sheet of material is strippably secured to the card so as to cover the confidential information while exposing the information designating the intended recipient thereof. By strippably securing, it is meant that a secure bond is affected between the opaque sheet and the message sheet, but that the opaque material may be easily peeled from the card by the designated recipient of the confidential information without affecting the interpretability of the confidential information.

U.S. Pat. No. 2,363,472, issued to Ritter, discloses a mailing card having on one side the usual provision for postage and the addressee's name; to provide a mailing card, the side opposite to the addressee and postage, with means for securing a detachable decalcomania transfer at a part thereof, with directions for detaching and for applying to a surface when detached, the other part of the side of the card to be utilized for a message and identification to the sender; to be enabled to use various decalcomania transfer emblems, medallions, and for advertising detachably secured to mailing cards at minimum cost.

The inventions heretofore known suffer from a number of disadvantages which include limited in application, difficult to use, and expensive.

What is needed is a mailing card that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available mailing cards. Accordingly, the present invention has been developed to provide a mailing card for mailing confidential information securely.

In one embodiment of the mailing card for mailing confidential information securely. The invention comprises: a card that may have a front and a back and may be configured to be mailed; a display layer may be over the front of the card; a security shield that may be removably coupled to the display layer and may include a design substantially matching the design of the display layer. In addition, the security shield may be selectably coupleable to a portion of the back of the card and may substantially opaque thereby it may enable a user to obscure writing thereon.

According to another embodiment of the mailing card, the security shield may include a pressure sensitive adhesive layer.

According to yet another embodiment of the mailing card, the security shield may be sized smaller than the display layer and may match the design of the display layer at borders of the security shield that may be disposed at a predetermined location over the display layer.

In still yet another embodiment of the mailing card, the security shield may be substantially identically match a portion of the design of the display layer.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). Understanding that these drawing(s) depict only typical embodiments of the invention and are not therefore to be considered to be limiting of its scope, the invention will be described and explained with additional specificity and detail through the use of the accompanying drawing(s), in which.

DETAILED DESCRIPTION OF THE INVENTION

Figure 1:
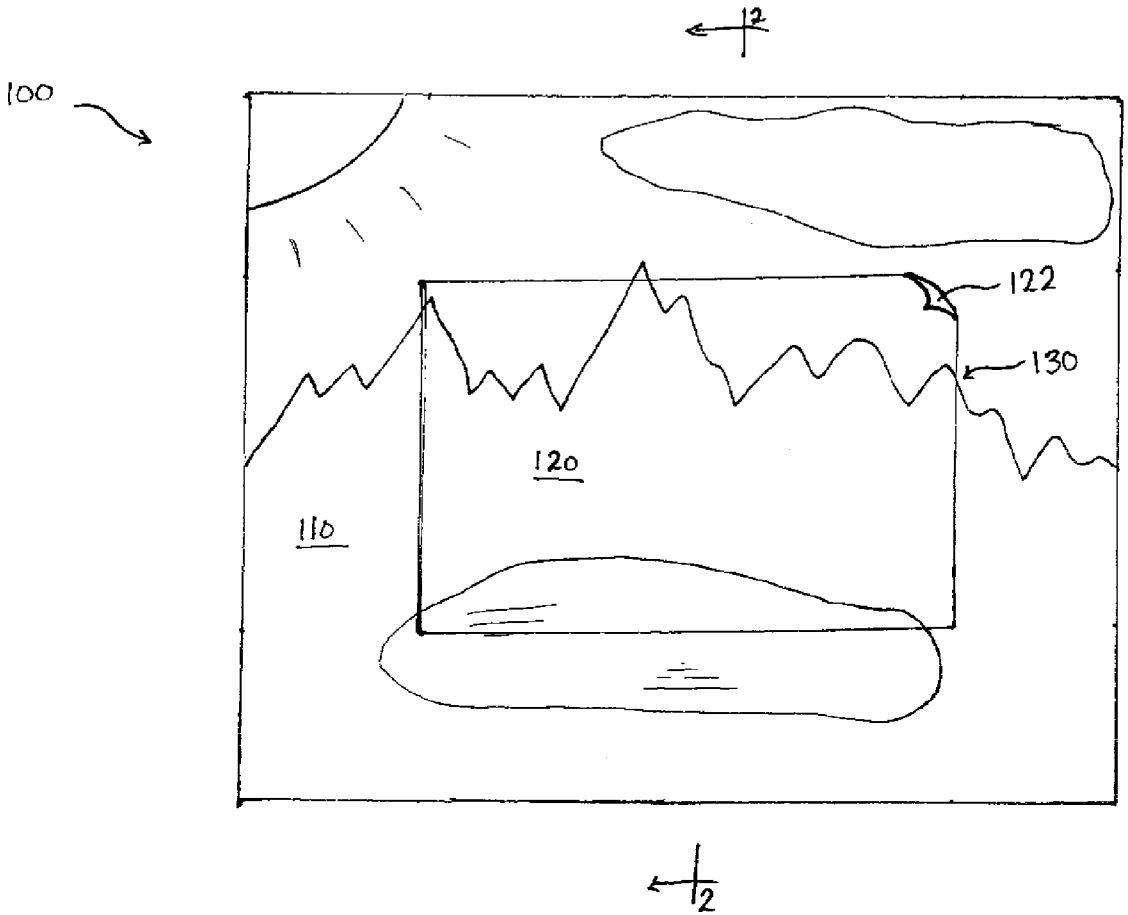
FIG. 1 is a front elevational view of a mailing card according to one embodiment of the invention.
Figure 2:
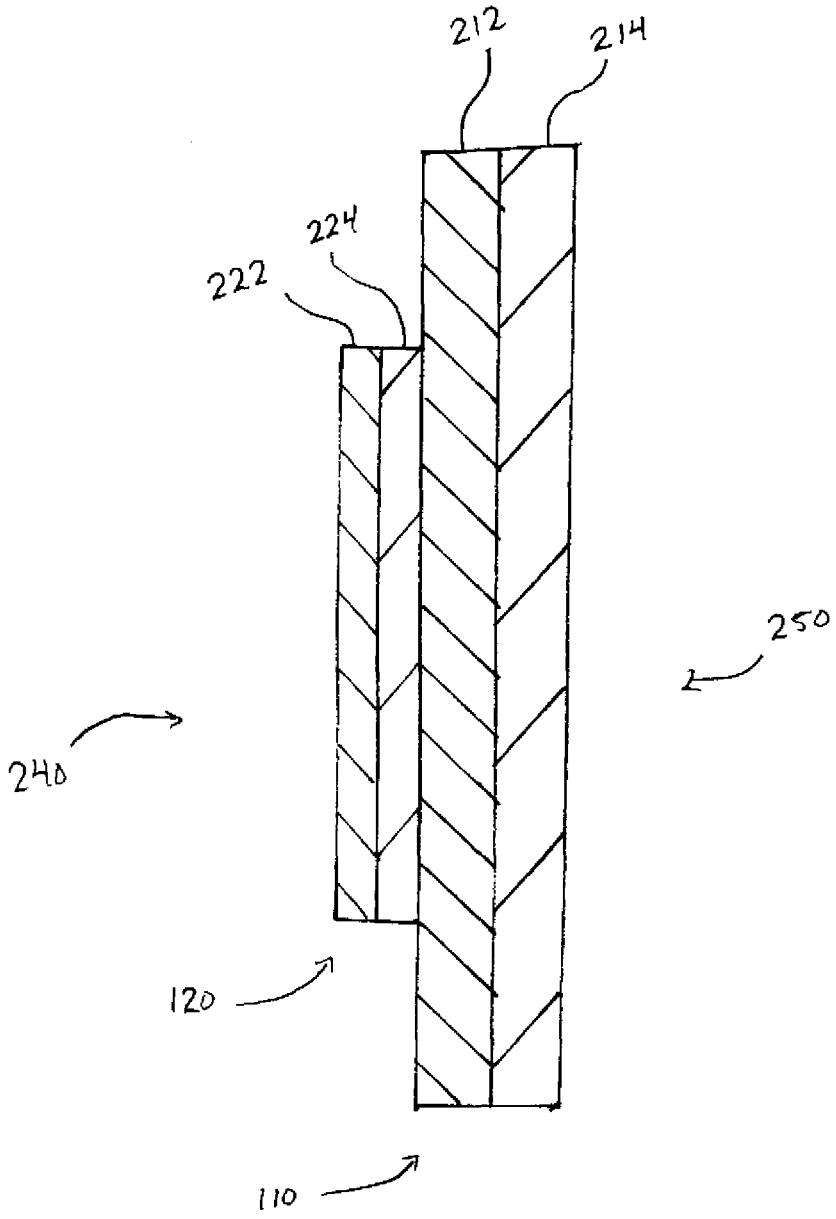
FIG. 2 is a cross sectional view of a mailing card according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising"

is to be interpreted as including the more restrictive terms "consisting of" and "consisting essentially of."

The figures illustrate a mailing card 100 according to one embodiment of the invention. There is shown a card 110 having a front 240 and a back 250 and configured to be mailed as a postcard. There is also shown a display layer 212 over/being the front of the card 110 and a writing layer 214 over/being the back of the card 110.

More, there is shown a security shield 120 removably coupled to the display layer 212 and include a design substantially matching the design of the display layer 212. The security shield 120 is selectably coupleable to a portion of the back 250 of the card 110 and substantially opaque thereby enabling a user to obscure writing thereon. The illustrated security 120 shield includes a pressure sensitive adhesive layer 224 and a substantially opaque layer 222.

Figure 3:
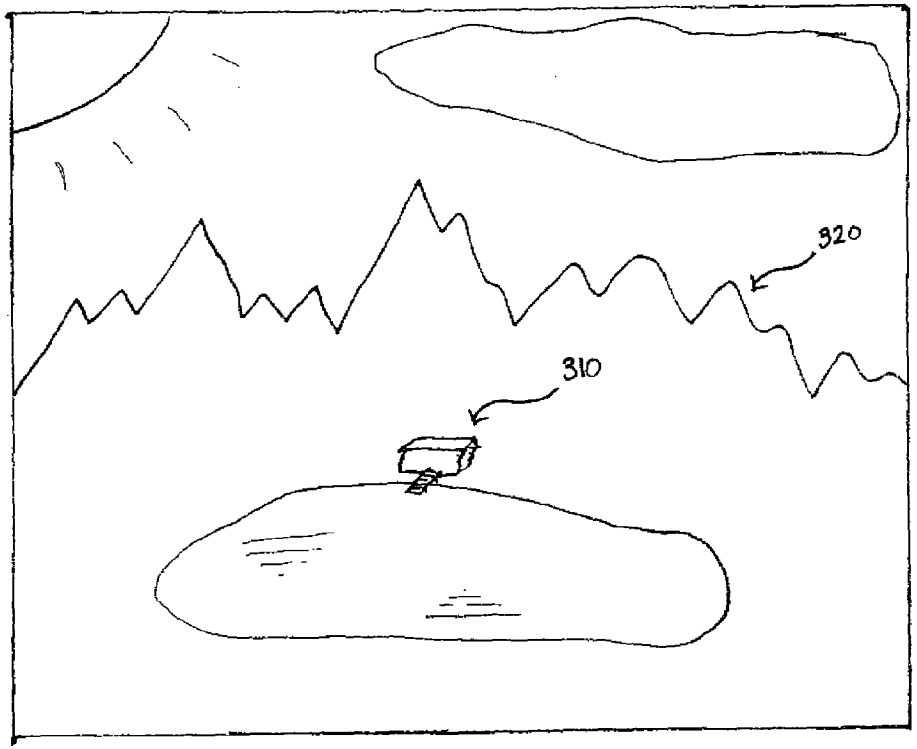
FIG. 3 is a front elevational view of a mailing card according to one embodiment of the invention.
Figure 4:
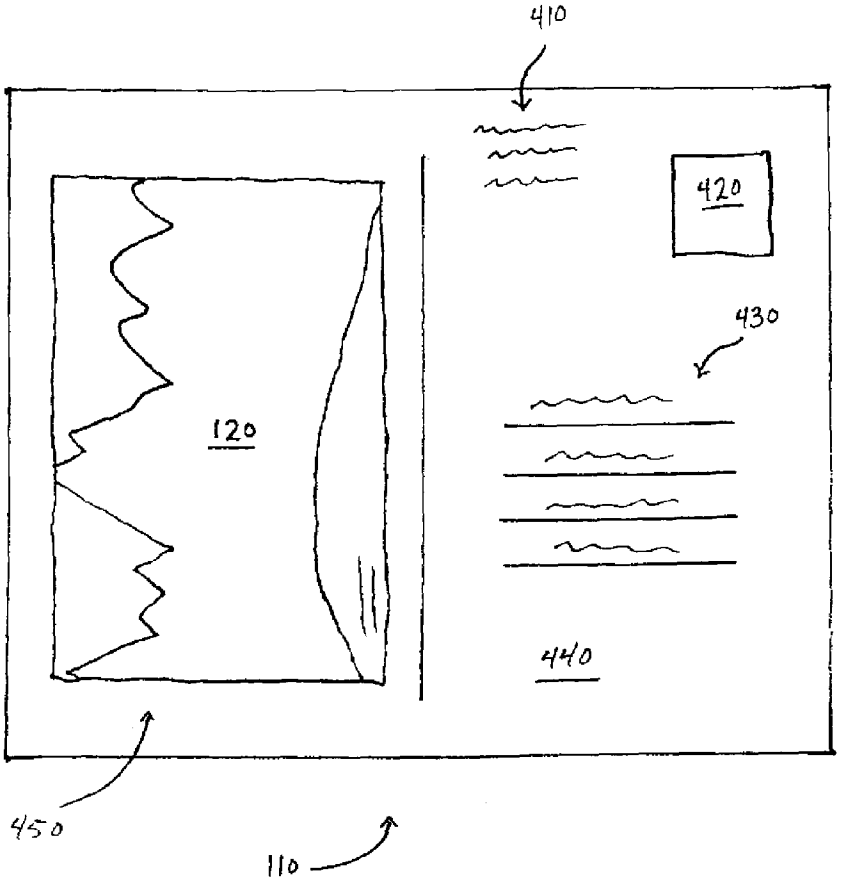
FIG. 4 is a back elevational view of a mailing card according to one embodiment of the invention.

The illustrated security shield 120 is sized smaller than the display layer 212. As shown in FIGS. 1 and 3, the illustrated security shield 120 matches 130 and 320 the design of the display layer 212 at borders of the security shield when disposed at a predetermined location over the display layer. In the illustrated example, there may be a variation 310 between what is displayed by the security shield 120 and what is displayed by the display layer 212. In another example, the security shield does not include a substantial variation and thereby substantially identically matches a portion of the design of the display layer. As used in this application substantial matching includes wherein an average person would not identify a variation on casual examination.

In operation, a user may purchase a mailing card 100 and write a message on a back writing portion 450 of the mailing card. The user may write an address on an address portion 430 and place postage on a postage portion 420. The user may also remove the security shield 120 from the front of the card 100, thereby revealing display material thereby that substantially matches the display material of the security shield 120. Accordingly, a card may be provided wherein the security shield provides correlated display material stored in a convenient location such that writing on the card may be selectably obscured by the user without obscuring mailing information and other information 440

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although particular shapes and sizes are illustrated, it is envisioned that the shapes and sizes included in the invention are plethoric.

Additionally, although the figures illustrate particular positions of the shield before use as a shield and during use as a shield, it is envisioned that the actual positions included within the invention are plethoric and relative to positions of items on the card.

Finally, it is envisioned that the components of the device may be constructed of a variety of materials, including but not limited to cloth, paper, and other woven fibers; plastics, rubbers and other polymers; metals; etc.; and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A mailing card design for mailing confidential information securely, comprising;

a) a card having four edges and a front and a back side, wherein the front side including a display layer to illustrate a printed design substantially covering the front of the card;

wherein the back side including:

i) no printed design similar to the printed design located on the front side thereon;

ii) an address section, designed to allow a user to print their intended address to receive the card upon mailing;

iii) a postage stamp section designed to have a postage stamp placed thereon to enable mailing of the card; and iv) a message section designed to provide space sufficient for a user to write a private message thereon the back side of the card;

b) a security shield, having a first and second removably affixed position on the card, i) wherein, while the security shield is in the first removably affixed position, the security shield is located on the front side of the card;

ii) wherein, while the security shield is in the first removably affixed position, the security shield is physically proportioned as to cover only a portion of the design located on the display layer;

iii) wherein, the security shield including, on a top visual surface thereon, a substantially identical design to that portion of the display layer that is being covered while the security shield is in the first removably affixed position;

iv) wherein, while the security shield is in the second removably affixed position, it is located on the back side of the card;

v) wherein, while the security shield is in the second removably affixed position, the security shield is physically positioned as to cover only the message section of the card;

vi) wherein, while the security shield is in the second removably affixed position, the security shield displays the substantially identical design to that portion of the display layer over the message section to prevent casual observers from clearly reading what is written in the message section;

vii) wherein, while the security shield is in the second removably affixed position, the front side positioned display layer provides unobstructed view to a user of the illustrated print design that substantially covers the front of the card.

2. The mailing card design of claim 1, wherein the security shield includes a pressure sensitive adhesive layer.

* * * * *